US006997011B2

(12) United States Patent
Gerstner et al.

(10) Patent No.: US 6,997,011 B2
(45) Date of Patent: Feb. 14, 2006

(54) SLIDING RAIL FOR A WIRE-TUBE EVAPORATOR, EVAPORATOR ASSEMBLY, AND REFRIGERATION UNIT WITH THE EVAPORATOR ASSEMBLY

(75) Inventors: Silvia Gerstner, Langenau (DE); Siegfried Grasy, Dornstadt (DE)

(73) Assignee: BSH Bosch und Siemens Hausgaraete GmbH, Munich (DE)

( * ) Notice: Subject to any disclaimer, the term of this patent is extended or adjusted under 35 U.S.C. 154(b) by 0 days.

(21) Appl. No.: 10/830,758

(22) Filed: Apr. 23, 2004

(65) Prior Publication Data

US 2004/0226315 A1 Nov. 18, 2004

Related U.S. Application Data

(63) Continuation of application No. PCT/EP02/11320, filed on Oct. 9, 2002.

(30) Foreign Application Priority Data

Oct. 23, 2001 (DE) ..... 201 17 578 U

(51) Int. Cl.
*F25B 39/02* (2006.01)

(52) U.S. Cl. ..... 62/515; 62/516; 165/78; 165/171

(58) Field of Classification Search ..... 62/515, 62/516, 517; 24/457, 485; 248/74.2, 229.16, 248/229.26, 231.81; 165/78, 171
See application file for complete search history.

(56) References Cited

U.S. PATENT DOCUMENTS 3,144,079 A 8/1964 Mack
4,009,595 A * 3/1977 Barnard et al. ..... 62/300
4,233,937 A * 11/1980 Steube ..... 118/727
4,338,994 A * 7/1982 Hewing et al. ..... 165/49
4,338,995 A * 7/1982 Shelley ..... 165/49
4,607,497 A * 8/1986 Ferdows et al. ..... 62/179
4,995,453 A * 2/1991 Bartlett ..... 165/150
5,263,535 A * 11/1993 Philo et al. ..... 165/67
5,329,784 A * 7/1994 Kennedy et al. ..... 62/262
5,639,354 A * 6/1997 Zellweger ..... 202/238
5,826,646 A * 10/1998 Bae et al. ..... 165/110
5,875,645 A * 3/1999 Dunnigan ..... 62/407
5,899,079 A * 5/1999 Dunnigan et al. ..... 62/80
6,185,957 B1 * 2/2001 Voss et al. ..... 62/513
6,324,727 B1 * 12/2001 Ortoleva et al. ..... 16/94 R

FOREIGN PATENT DOCUMENTS

DE 1 401 534 12/1968
DE 27 16 289 A1 10/1978
DE 197 44 740 A1 4/1999
EP 0534107 A1 * 8/1992
JP 09266877 A 10/1997
JP 11094204 A * 4/1999

* cited by examiner

*Primary Examiner*—Mohammad M. Ali

(74) *Attorney, Agent, or Firm*—John T. Winburn; Russell W. Warnock; Craig J. Loest

(57) ABSTRACT

A sliding rail for a wire-tube evaporator has an elongated rail body to be mounted on the evaporator and to protect the latter against abrasion caused by a frozen product container that slides above or on the evaporator. The sliding rail includes at least a tubular clamp for fixing the rail body on a refrigerating pipe of the evaporator. The tubular clamp is mounted on an arm projecting laterally relative to the rail body.

11 Claims, 2 Drawing Sheets

SLIDING RAIL FOR A WIRE-TUBE EVAPORATOR, EVAPORATOR ASSEMBLY, AND REFRIGERATION UNIT WITH THE EVAPORATOR ASSEMBLY

CROSS-REFERENCE TO RELATED APPLICATION

This application is a continuation, under 35 U.S.C. §120, of copending international application No. PCT/EP02/11320, filed Oct. 9, 2002, which designated the United States; this application also claims the priority, under 35 U.S.C. §119, of German patent application No. 201 17 578.9, filed Oct. 23, 2001; the prior applications are herewith incorporated by reference in their entirety.

BACKGROUND OF THE INVENTION

Field of the Invention

The present invention relates to a sliding rail for a wire-tube evaporator, to an assembly with a sliding rail and such an evaporator, and to a refrigerator equipped therewith.

A wire-tube evaporator is conventionally constructed from a tube for a refrigerant, with the tube extending in a meandering shape in one plane, and from a multiplicity of wires which are connected to the tube above or below the latter at a plurality of points, on the one hand, in order to provide a mechanically stable rigid arrangement and, on the other hand, in order to enlarge the effective heat exchange surface of the evaporator.

Wire-tube evaporators of this type are used, in particular, in freezer cabinets where they are disposed in each case in planes between two frozen-product containers, in order to cool the contents of the latter efficiently.

In order to utilize the available internal volume of the refrigerator to the best possible extent, these frozen-product containers are mounted at the shortest possible vertical distance from the wire-tube evaporator. When there is a full load, there is the possibility that the frozen-product containers bend out of shape slightly, the result of which may be that the bottom of one frozen-product container touches the wire-tube evaporator lying beneath it. When the frozen-product container is drawn out, it brushes over the evaporator, and this may lead to abrasion and premature wear.

In order to avoid such abrasion, it has become known to fasten to the refrigerant tube of the evaporator a sliding rail which extends between the evaporator and a frozen-product container lying above the latter. The sliding rail prevents direct contact between the frozen-product container and the evaporator and thus prevents the evaporator from being damaged due to friction; moreover, the sliding rail has a low degree of friction on the surface facing the frozen-product container, so that, even on the latter, abrasion is largely avoided.

Sliding rails of this type are conventionally clamped directly onto the tubes of a wire-tube evaporator. However, this solution is not fully satisfactory. To be precise, so that the evaporators can be mounted in a simple way, it is necessary that their inlet and outlet for refrigerant are located at the same edge of the substantially plate-shaped evaporator. This is preferably the rear edge facing away from the door of the refrigerator. There is necessarily an even number of parallel tube sections within the evaporator which extend between this edge and the opposite edge. If the tube sections of the evaporator are distributed uniformly over its width, either there is no tube section which extends along a center line of the evaporator of the rear wall to the door of the refrigerator or the distribution of the tube sections in the direction of width of the evaporator is asymmetric. In the former instance, in each case two sliding rails have to be arranged symmetrically, since, if only one sliding rail is arranged on one side of the center, this causes a sideway twist when the frozen-product container is drawn out and pushed in and, consequently, the risk that the latter will be jammed. In the case of an asymmetric arrangement of the refrigerant line, it is possible to lead a tube section from it exactly along the center line and fasten a sliding rail to this tube section. However, because of its asymmetry, this solution is unfavorable from manufacturing points of view and in terms of the distribution of the cooling capacity within the refrigerator.

SUMMARY OF THE INVENTION

It is accordingly an object of the invention to provide a sliding rail for a wire tube evaporator which overcomes the above-mentioned disadvantages of the heretofore-known devices and methods of this general type and which specifies a sliding rail for a wire-tube evaporator, which can be placed exactly along a center line of the evaporator, even when no section of the refrigerant tube of the evaporator extends along this center line.

With the foregoing and other objects in view there is provided, in accordance with the invention, an evaporator assembly, comprising:

a wire-tube evaporator having an evaporator tube;

a sliding rail having an elongate rail body, an arm projecting laterally from the rail body, and a tube clip disposed on the arm and configured for attaching the rail body to the evaporator tube.

The laterally projecting arm makes it possible to fasten the sliding rail with basically any desired lateral offset, corresponding to the arm length, with respect to the tube section to which the tube clip is fastened. Such a sliding rail may, in principle, be provided suitably for any desired arrangement of the refrigerant tube in the wire-tube evaporator, in such a way that the sliding rail extends along the center line of the evaporator.

In order to avoid the pivoting of the sliding rail about the tube clip engaging, offset, on the tube under a tensile load caused by a frozen-product container brushing over it, preferably at least two arms with a tube clip attached to them are provided.

In accordance with a preferred aspect of the invention, these arms are attached on the same longitudinal side of the rail body. This makes it possible to use an identical sliding rail for wire-tube evaporators wherein the distances between parallel tube sections differ slightly from one another, or, when there is a spread in the distance between parallel tube sections as a consequence of manufacture, this does not lead to an oblique orientation of the sliding rail with respect to the center line when the arms are arranged in this way.

In order to prevent the situation where a frictional force acting on the sliding rail when a frozen-product container is drawn out or pushed in may lead to a displacement of the sliding rail, the rail body preferably has arranged on it a hook with an introduction gap open in the longitudinal direction of the rail body, which hook can receive a wire of the evaporator and thus support the rail body on this wire in the direction of tensile or shearing force. For the same purpose, a wire clip may be arranged, with an introduction gap open transversely to the longitudinal direction of the rail body and intended for introducing a wire of the evaporator on the rail body.

Preferably, both the hook and the wire clip are present in each case at opposite longitudinal ends of the rail body, so that the sliding rail can easily be mounted first by arranging the hook on a wire of the evaporator and then by folding the rail body against the evaporator and plugging the wire clip onto the second wire.

The rail body and the at least one arm are preferably molded in one piece from a plastic.

The subject of the invention is also a combination consisting of a wire-tube evaporator and of at least one sliding rail, as defined above, and a freezer having such an assembly.

Other features which are considered as characteristic for the invention are set forth in the appended claims.

Although the invention is illustrated and described herein as embodied in a sliding rail for a wire-tube evaporator, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
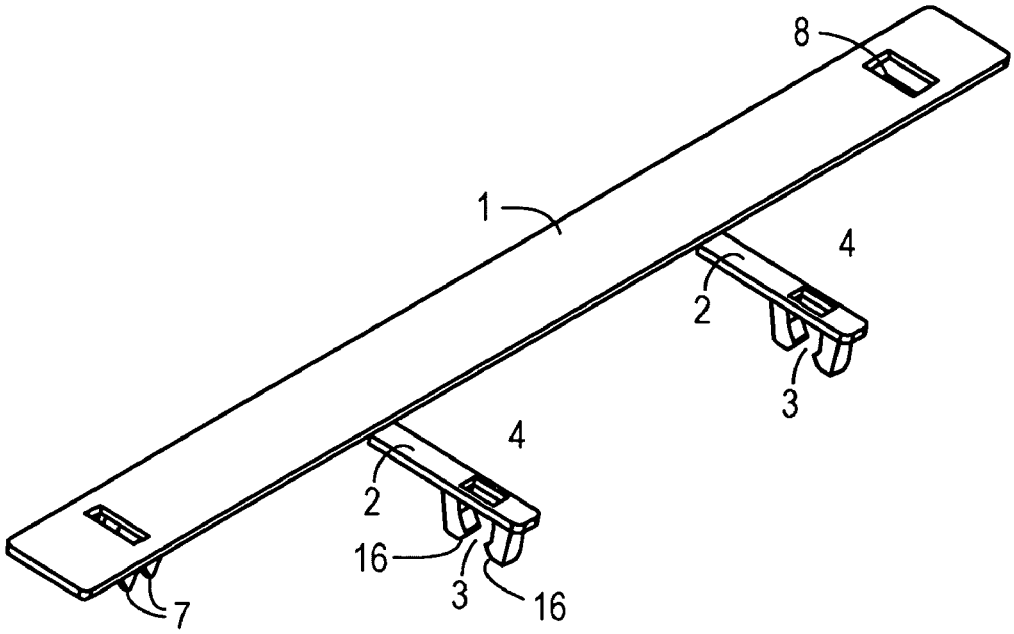
FIG. 1 is a top perspective view of a sliding rail according to the invention.

Referring now to the figures of the drawing in detail and first, particularly, to FIGS. 1 and 2 thereof, the construction of the sliding rail is best described with reference to the two perspective views. An elongate plate-like rail body 1 has a smooth top side. Two arms 2 extend at right angles from one of the longitudinal edges of the rail body 1 and each of the arms 2 carries on its underside two downwardly projecting tongues forming a tube clip 3. The free cross section of the tube clip 3 is suitably dimensioned in order to engage positively around a refrigerant line of a wire-tube evaporator, as will be discussed in more detail below in connection with FIG. 3. An orifice 4 formed on the top side of each arm 2 between the tongues of the tube clip 3 makes it easier, on the one hand, in that it weakens the arm 2 mechanically, to spread the tongues apart and consequently plug the tube clip 3 onto the refrigerant tube and, on the other hand, to mold the entire sliding rail, including mutually confronting projections 16 of the tongues, with the aid of only two molding dies which do not have to have any moveable parts.

The top side of the arms 2, which can be seen in FIG. 1, lies at a slightly lower level than the top side of the rail body 1, so that, when a frozen-product container slides over the top side of the rail body 1, there is no risk that the frozen-product container will be caught on the edges of the arms 2, the edges extending transversely to the longitudinal direction of the rail body 1.

Figure 2:
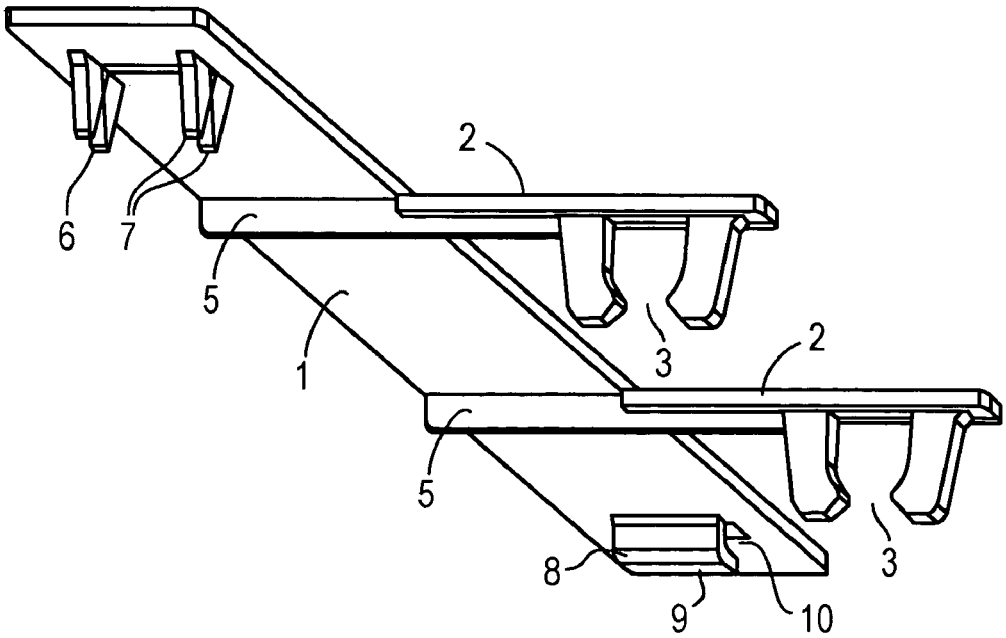
FIG. 2 is a bottom perspective view of the sliding rail from below.

With reference to FIG. 2, the arms 2 are reinforced in each case by way of downwardly projecting webs 5 which give the arms 2 a T-shaped cross section in their middle region, between the rail body 1 and the tube clip 3. The thickness of the crossbar of the T, which also corresponds to the thickness of the arm 2 in the region of the orifice 4, is matched to the diameter of the tubes of the wire-tube evaporator, so that the arm 2 does not project above and beyond two wires of the evaporator between which it extends in the mounted state; the height of the reinforcing web 5 may be markedly greater, since, after mounting, the latter engages into a free space of the wire-tube evaporator.

Means for fastening the rail body to the wires of the wire-tube evaporator are arranged in each case at the longitudinal ends of the rail body 1.

These means consist here, on the one hand, of a wire clip 6 with two pairs of tongues 7 located opposite one another, which correspond in construction and function to the tongues of the tube clip 3 and which are adapted merely in their dimensions for being plugged onto a wire of the evaporator.

A hook 8, as a device for fastening the rail body, is formed in one piece at the second end of the rail body 1, the end facing away from the observer in FIGS. 1 and 2. The hook 8, here in the form of an L-shaped projection, has a free end portion 9 which is parallel to the rail body 1 and which delimits a receiving gap, open toward the end of the rail body 1, for a wire of the wire-tube evaporator. The gap 10, here, is open toward the end of the rail body 1; it could, however, also be oriented in the opposite direction, with its orifice facing the middle of the rail body 1. A hole located opposite the free end portion 9 of the rail body 1 renders it possible for the rail body 1 and the hook 8 to be molded by way of only two rigid molding dies.

The fastening device could, of course, also comprise more than one hook or one clip at each end of the rail body; there could also be only wire clips provided at both ends of the rail body.

Figure 3:
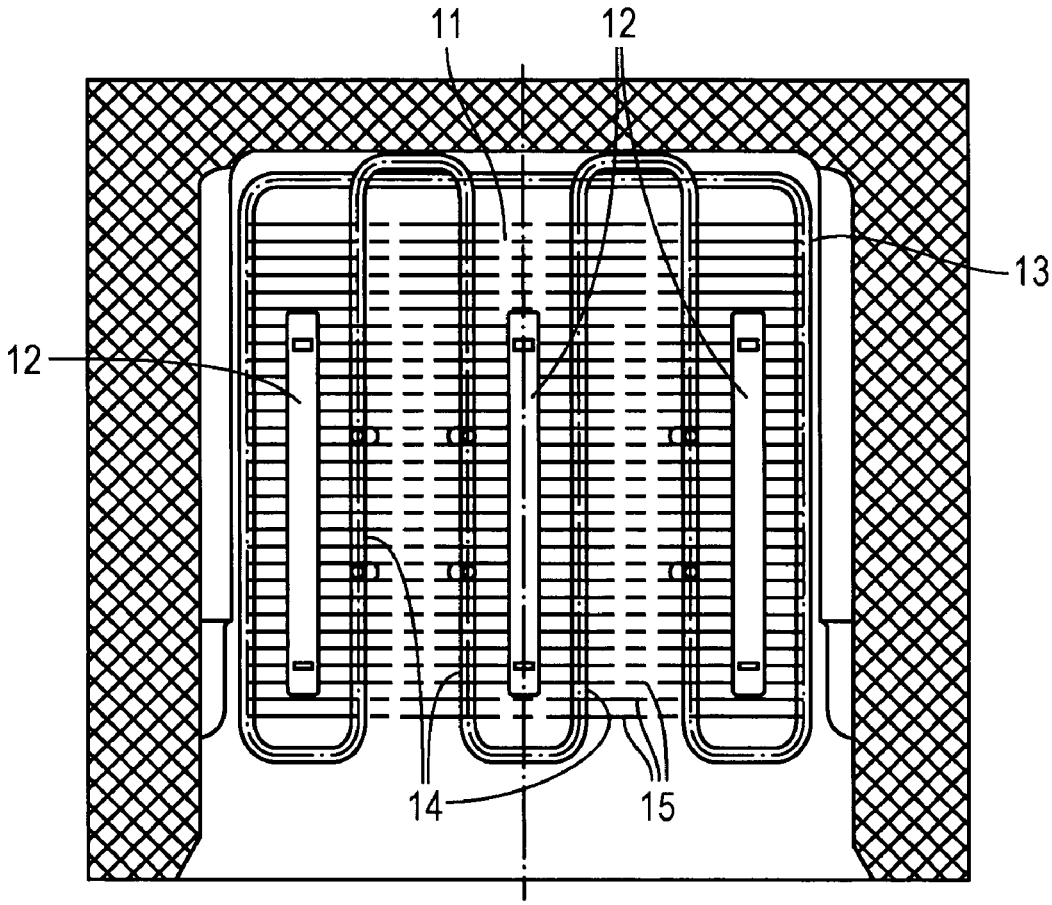
FIG. 3 is a diagrammatic section taken through a refrigerator, wherein a wire-tube evaporator equipped with sliding rails according to the invention can be seen from above.

FIG. 3 shows a diagrammatic horizontal section through a refrigerator with a wire-tube evaporator 11 which is equipped with three sliding rails 12 according to the invention. The wire-tube evaporator 11 has a refrigerant tube line 13 with a total of six tube sections 14 extending parallel to a center line M of the refrigerator from a rear wall of the refrigerator to the door aperture of the latter. The tube sections 14, which extend in a meander or serpentine, are connected to and reinforced with one another by way of a multiplicity of wires 15 oriented transversely to the center line M.

The arrangement of the refrigerant tube line 13 is symmetrical with respect to the center line M, so that none of the parallel tube sections 14 extends along the center line M. Instead, one of the three sliding rails 12 is arranged along this center line M. It is retained on the wires 15 in the forward and backward directions with the aid of its wire clip 6 and the hook 8 and is also anchored in the transverse direction by way of the tube clips 3.

We claim:

1. An evaporator assembly, comprising:

an evaporator having an evaporator tube;

a sliding rail having an elongate rail body, an arm projecting laterally from said rail body, and a tube clip disposed on said arm and configured for attaching said rail body to said evaporator tube.

2. The evaporator assembly according to claim 1, wherein said arm is one of at least two arms projecting from said sliding rail and each having a respective said tube clip attached thereto.

3. The evaporator assembly according to claim 2, wherein said arms project from a common longitudinal side of said rail body.

4. The evaporator assembly according to claim 1, wherein said evaporator is a wire-tube evaporator having wires extending between turns of said tube, and said rail body carries a hook formed with an insertion gap, open in a longitudinal direction of said rail body, for receiving a respective said wire or said evaporator.

5. The evaporator assembly according to claim 1, wherein said evaporator is a wire-tube evaporator having wires extending between turns of said tube, and said rail body carries a wire clip with an insertion gap, open transversely to a longitudinal direction of said rail body, for receiving a respective said wire of said evaporator.

6. The evaporator assembly according to claim 1, wherein said evaporator is a wire-tube evaporator having wires extending between turns of said tube, and said rail body carries a hook at one end thereof formed with an insertion gap, open in a longitudinal direction of said rail body, for receiving a respective said wire or said evaporator, and said rail body carries a wire clip at an end thereof opposite from said hook with an insertion gap, open transversely to a longitudinal direction of said rail body, for receiving a respective said wire of said evaporator.

7. The evaporator assembly according to claim 1, wherein said rail body and said at least one arm are integrally molded in one piece from plastic material.

8. In combination with a freezer appliance, the evaporator assembly according to claim 1.

9. The evaporator assembly according to claim 1, wherein said evaporator is a wire-tube evaporator having tubes with turns, and wires extending between said turns; and said rail body has two opposing ends, defines a longitudinal direction and a transverse direction transverse to said longitudinal direction, has a hook at a first of said two ends, said hook has an insertion gap open in said longitudinal direction for receiving one of said wires or said tubes, and has a wire clip at a second of said two ends, said wire clip has an insertion gap open in said transverse direction for receiving one of said wires.

10. An evaporator assembly, comprising:

an evaporator having:

wires having a shape; and an evaporator tube connected to said wires and having turns and sections; and a sliding rail having:

a rail body having a longitudinal extent;

an arm projecting laterally from said rail body; and a tube clip disposed on said arm and having an interior shape adapted to said shape of said evaporator tube for connecting said rail body to said evaporator tube.

11. An evaporator assembly, comprising:

an evaporator having:

wires; and an evaporator tube connected to said wires, said evaporator tube having:

a given shape; and turns and sections;

said evaporator tube defining a centerline and being symmetric about said centerline, said sections being parallel to said centerline and disposed at respective distances from said centerline; and at least one sliding rail having:

a rail body defining a longitudinal extent;

at least one arm projecting laterally from said rail body; and a tube clip disposed on said arm and having an interior shape adapted to said given shape of said evaporator tube; and said at least one sliding rail being removably connected to said evaporator tube by said tube clip and aligning said longitudinal extent of said rail body substantially along said centerline.

* * * * *